US006864222B1

(12) United States Patent
Manske

(10) Patent No.: US 6,864,222 B1
(45) Date of Patent: Mar. 8, 2005

(54) BLOOMING NATURAL OIL CLEANING COMPOSITIONS

(75) Inventor: Scott D. Manske, Davidson, NC (US)

(73) Assignee: Clariant Finance (BVI) Limited, Tortola (VG)

( * ) Notice: Subject to any disclaimer, the term of this patent is extended or adjusted under 35 U.S.C. 154(b) by 0 days.

(21) Appl. No.: 10/717,267

(22) Filed: Nov. 19, 2003

(51) Int. Cl.[7] ..... C11D 17/00

(52) U.S. Cl. ..... 510/463; 510/423; 510/504; 510/384; 134/40; 134/42

(58) Field of Search ..... 510/463, 423, 510/384, 504; 134/40, 42

(56) References Cited

U.S. PATENT DOCUMENTS

| | | | | |
|---|---|---|---|---|
| 5,591,708 | A | 1/1997 | Richter | 510/463 |
| 5,629,280 | A | 5/1997 | Richter et al. | 510/463 |
| 5,728,672 | A | 3/1998 | Richter | 510/463 |
| 5,773,395 | A | 6/1998 | Charlez et al. | 510/101 |
| 5,925,681 | A | 7/1999 | Crisanti et al. | 514/643 |
| 5,939,374 | A | 8/1999 | Richter et al. | 510/384 |
| 5,985,819 | A | 11/1999 | Lu et al. | 510/463 |
| 6,030,936 | A | 2/2000 | Lu et al. | 510/424 |
| 6,066,606 | A | 5/2000 | Lu et al. | 510/101 |
| 6,075,002 | A | 6/2000 | Cheung et al. | 510/384 |
| 6,100,231 | A | 8/2000 | Cheung et al. | 510/433 |
| 6,110,295 | A | 8/2000 | Lu et al. | 134/42 |
| 6,140,284 | A | 10/2000 | Cheung et al. | 510/101 |
| 6,143,703 | A | 11/2000 | Cheung et al. | 510/101 |
| 6,147,047 | A | 11/2000 | Robbins et al. | 510/417 |
| 6,177,388 | B1 | 1/2001 | Cheung et al. | 510/101 |
| 6,184,195 | B1 | 2/2001 | Cheung et al. | 510/432 |
| 6,194,362 | B1 | 2/2001 | Trinh et al. | 510/101 |
| 6,395,697 | B1 | 5/2002 | Cheung et al. | 510/382 |
| 6,465,411 | B2 | 10/2002 | Manske et al. | 510/417 |

*Primary Examiner*—Necholus Ogden
(74) *Attorney, Agent, or Firm*—Richard P. Silverman

(57) ABSTRACT

The present invention relates to blooming type cleaning compositions comprising natural oil. More particularly, the present invention relates environmentally acceptable, blooming natural oil cleaning compositions which achieve product stability and clarity with essentially one natural oil without the addition of pine oil, amine oxides, amphoteric surfactants or phenolic solvents.

13 Claims, No Drawings

BLOOMING NATURAL OIL CLEANING COMPOSITIONS

FIELD OF THE INVENTION

The present invention relates to blooming type cleaning compositions comprising natural oil. More particularly, the present invention relates environmentally acceptable, blooming, natural oil cleaning compositions which achieve product stability and clarity with essentially one natural oil without the addition of pine oil, amine oxides, amphoteric surfactants or phenolic solvents.

BACKGROUND OF THE INVENTION

Dilutable cleaners are often oil-in-water microemulsion compositions which transform from clear, translucent liquids to milky white or milky yellowish white, cloudy (opaque) solutions upon dilution with sufficient water. This phenomenon is referred to in the art as "bloom" or "blooming" or "break" and is most commonly the result of the microemulsion "breaking" and the subsequent formation of a macroemulsion. Blooming is a property exhibited by dilutable compositions such as known cleaning compositions, for example pine oil type cleaning compositions which contain a significant amount (generally at least about 5% and more) of pine oil comprised of a significant proportion of terpene alcohols. Blooming is an important characteristic from a consumer standpoint as it provides a visual indicator and impression to the consumer that the concentrated product contains active cleaning and/or disinfecting constituents which are released upon addition of the concentrate to a volume of water. Such is an important visual indicator of apparent efficacy of a concentrated product.

While presently commercially available materials have advantageous features, they are not without their attendant shortcomings as well. Blooming dilutable cleaners based on natural oils are well known. The majority of these are based on natural oils such as pine oil. Pine oil is used because of its biocidal properties, its odor profile, its grease solubilizing properties, its relative ease in formulating a stable blooming product, and its blooming characteristics when a property formulated product is diluted with water. Despite these advantages, the use of pine oil with its characteristically pungent odor is frequently not desired. A further disadvantage of pine oil is that if significant amounts of pine oil are present in a blooming composition, the cleaner may deposit an undesirable sticky residue on hard surfaces.

To satisfy these consumer demands for an effective blooming cleaning composition, other natural oils with alternative odor profiles have been considered in blooming dilutable cleaners. Unfortunately, many of these natural oils are more difficult to incorporate in a stable composition which also has a blooming property. U.S. Pat. No. 6,194,362 discloses glass cleaning compositions containing blooming perfume wherein the perfume composition comprises at least 5 different blooming perfume ingredients presumably to achieve adequate bloom. Orange oil for instance has a very fresh and clean aroma which is quite appealing for use in cleaning products, but orange oil is generally more challenging to efficiently incorporate into a blooming household cleaning product. As a solution to the problem of incorporating orange oil into a blooming cleaning composition, others have sought to combine the orange oil with pine oil to achieve a stable and clear formulation which also has a blooming property. The following is a partial list of patents which require the inclusion of pine oil: U.S. Pat. No. 6,465,411, U.S. Pat. No. 6,110,295, U.S. Pat. No. 6,075,002, U.S. Pat. No. 6,030,936, U.S. Pat. No. 6,100,231, U.S. Pat. No. 5,985,819, U.S. Pat. No. 5,728,672, U.S. Pat. No. 5,629,280, U.S. Pat. No. 5,591,708, and U.S. Pat. No. 4,414,128. However, the combination of even relatively small amounts of pine oil in orange oil cleaning compositions presents a problem in that some consumers find the odor profile of pine oil—even at these minimum levels—to be too harsh or generally unappealing.

A product that blooms well (quickly and in a visually pronounced fashion) is often perceived by consumers as being a more effective cleaner than a product that blooms poorly. For the bloom phenomena to occur during consumer use, the cleaning products must be physically stable as a clear liquid prior to use while in the concentrated form before dilution. Surfactants are the primary agents used to emulsify an oil, but often other ingredients are required to provide the adequate product stability and clarity in a blooming dilutable cleaner. Typically, to maintain the translucency of a formulation, organic solvents or other coupling agents are often used to physically stabilize the natural oil in a microemulsion. However, these organic solvents add very little to the cleaning efficacy of a dilutable cleaner. Such organic solvents in blooming cleaning compositions typically include alkyl phenyl and alkyl diphenyl solvents. These organic solvents often contribute an unwanted solvent odor to the finished product, and they are often viewed as environmental unfriendly. In fact, the use of some organic solvents in household cleaning products is limited by some regulating bodies in conjunction with efforts to protect the environment. Examples include the following patents—U.S. Pat. No. 6,184,195, U.S. Pat. No. 6,177,388, U.S. Pat. No. 6,143,703, and U.S. Pat. No. 6,395,697—which disclose blooming cleaning formulas incorporating natural oils which require, among other ingredients, an alkyl diphenyl solvent presumably to achieve adequate formula stability. Alkyl diphenyl solvents are representative of organic solvents which biodegrade more slowly than non-aromatic solvents and therefore are not the environmentally preferred as a stabilizing or clarifying agent in blooming cleaning compositions.

Other attempts to produce a blooming cleaning composition have incorporated specialty, higher cost surfactants to enhance the bloom effect. U.S. Pat. No. 6,066,606 discloses a blooming type cleaning composition which requires a bloom enhancing effective amount of at least one amphoteric surfactant. U.S. Pat. No. 6,140,284 discloses botanical oils as blooming agents in hard surface cleaning compositions which require at least one botanical oil solubilizing surfactant selected from amine oxide surfactants. However, amine oxides are inferior emulsifiers for this application as demonstrated by the examples provided in the patent. Each formulation included in Table 1 of U.S. Pat. No. 6,140,284 incorporates 8 percent natural oil and 33 percent of stabilizing and clarifying agents (12 percent isopropyl alcohol, 20 percent propylene glycol, 1 percent lauryl alcohol).

Accordingly, it is an object of the present invention to provide a blooming concentrated cleaner capable of dilution for use as an all purpose cleaner.

It is a further object of the present invention to provide a blooming cleaner that forms a milky bloom upon dilution with an appropriate amount of water at consumer relevant water hardness levels.

It is yet a further object of the present invention to provide a blooming cleaner which avoids the use of cost-ineffective ingredients such as amine oxides, amphoteric surfactants, and alkyl diphenyl solvents.

It is a further objective of the present invention to provide a blooming cleaner which avoids the unnecessary use of large amount of noncleaning functional (in a dilatable application) ingredients such as organic solvents.

It is still a further object of the present of the invention to provide a blooming cleaner which is phase stable and translucent—while in the undiluted form—under consumer relevant temperature conditions.

SUMMARY OF THE INVENTION

The present invention discloses blooming cleaning compositions for non-pine oil based natural oil containing, stable blooming cleaning compositions which bloom upon dilution when combined with sufficient quantities of water. These blooming cleaning compositions require 3 to 20 percent of one to three natural oils, an anionic surfactant which is preferably an alkane sulfonate, and a nonionic surfactant with an HLB below 10. Optional ingredients include non-phenolic organic solvents, inorganic salts, sequestration agents, colorants, biocidal agents, additional fragrances, viscosity modifiers, pH modifiers, and degreasing agents. The balance of the composition is water. The compositions described by the present invention explicitly exclude pine oil. The compositions described by the present invention explicitly exclude and are essentially free of blooming agents selected from the group consisting of amine oxides, amphoteric surfactants, and phenolic solvents which are unnecessary ingredients for achieving bloom in the instant invention and are not cost-effective. The compositions described by the present invention explicitly exclude alkyl phenyl solvents which were found to be relatively costly, unnecessary ingredients for achieving product stability and clarity and are not environmentally preferred options. The compositions described by the present invention require only one natural oil, such as orange oil, to achieve an excellent bloom but also may include up to three distinct natural oil ingredients.

DETAILED DESCRIPTION OF THE INVENTION

As an essential constituent in the concentrate compositions according to the present invention there are present one or more natural or botanical oils, sometimes also referred to as "essential oils" which are useful in providing a blooming effect. By way of non-limiting example these include one or more of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69 .degree. C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methhyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen. Each of these botanical oils is commercially available. As noted previously, the inventive compositions do not include pine oil, although pine oil is known to the prior art to provide blooming effects.

The particularly preferred oil is orange oil. It may be commercially obtained from a variety of suppliers including Florida Chemical Company Inc.

These oils may be present in the compositions in any amounts which are effective in providing a desirable blooming effect. Generally amounts from as little as 3% wt. to amounts of 20% wt. are useful, based on the total weight of the concentrated liquid composition. More preferably these oils are present in amounts of from 3–15% wt., still more preferably 4–15% wt., and most preferably in amounts of from 4–12% wt. Of course, more than one oil may be used in a particular composition.

As noted previously, the compositions are aqueous in nature. Water is added in order to provide 100% by weight of the concentrate composition. The water may be tap water, but is preferably distilled and/or deionized water. If the water is tap water, it is preferably appropriately filtered in order to remove any undesirable impurities such as organics or inorganics, especially minerals salts which are present in hard water which may thus interfere with the operation of the other constituents of the invention, as well as any other optional components of the liquid concentrates according to the invention.

Water is added in amounts which are sufficient to form the concentrated compositions which amount is sufficient to ensure the retention of a substantially clear characteristic when produced as a concentrate, but at the same time ensuring good blooming upon the addition of the concentrated composition to a further amount of water, or upon the addition of further water to the concentrate.

Other conventional additives known to the art but not expressly enumerated here may also be included in the compositions according to the invention. By way of non-limiting example without limitation these may include: chelating agents, coloring agents, light stabilizers, fragrances, viscosity modifying agents, hydrotropes, pH adjusting agents, pH buffers as well as one or more detersive surfactant constituents including anionic, carbonic, and non-ionic surfactants. Many of these materials are known to the art, per se, and are described in McCutcheon 's Detergents and Emulsifiers, North American Edition, 1998; Kirk-Othmer, Encyclopedia of Chemical Technology, 4th Ed., Vol. 23, pp. 478–541 (1997), the contents of which are herein incorporated by reference. Such optional, i.e., non-essential constituents should be selected so to have little or no detrimental effect upon the desirable characteristics of the present invention, namely the blooming behavior, cleaning efficacy, and low toxicity as provided by the inventive compositions. Generally the total weight of such further conventional additives may comprise up to 25% by weight of a concentrated composition formulation.

Further optional, but advantageously included constituents are one or more coloring agents which find use in modifying the appearance of the concentrate compositions and enhance their appearance from the perspective of a consumer or other end user. Known coloring agents, may be incorporated in the compositions in effective amount to improve or impart to concentrate compositions a desired appearance. Such a coloring agent or coloring agents may be added in any useful amount in a conventional fashion, i.e., admixing to a concentrate composition or blending with other constituents used to form a concentrate composition. Known art light stabilizer constituents may also be added, particularly wherein coloring agents are used in a composition. As is known to the art, such light stabilizers act to retain the appearance characteristics of the concentrate compositions over longer intervals of time.

According to the present invention, the natural oil cleaning composition is essentially free of a blooming agent selected from the group consisting of an amine oxide, an amphoteric surfactant, a phenolic solvent, and mixtures thereof which are unnecessary ingredients for achieving bloom in the present invention. By essentially free of a blooming agent, it is meant that the concentration of the blooming agent is less than about 0.1 weight percent of the total weight of the natural oil cleaning composition. More preferably, the concentration of the blooming agent is less than about 0.01 weight percent of the total weight of the natural oil cleaning composition, and most preferably, concentration of the blooming agent is less than about 0.005 weight percent of the total weight of the natural oil cleaning composition.

Anionic Surfactants

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic sulfate surfactants suitable for use in the compositions of the invention include linear and branched primary and secondary alkyl sulfates, alkyl ethoxysulfates, fatty oleoyl glycerol sulfates, and alkyl phenol ethylene oxide ether sulfates.

Suitable anionic carboxylate surfactants include alkyl ethoxy carboxylates, alkyl polyethoxy polycarboxylate surfactants and soaps ("alkyl carboxyls").

An example of a preferred anionic surfactant would be the sodium salt of secondary alkane sulfonate commercially available under the tradename of Hostapur® SAS (Clariant Corporation, Charlotte, N.C.).

Nonionic Surfactants

Nonionic surfactants are oftened characterised by a term called the Hydrophile Lipophile Balance or HLB. This term is fully defined in several reference books including "Surfactants and Interfacial Phenomena" by M. J. Rosen. The HLB value of a nonionic surfactant is regularly used to characterize its emulsification properties.

In one embodiment, the alcohol alkoxylate is represented by the formula $$R^{13}\ O—[CH_2\ CH(R^{14})O]_m—H$$

wherein $R^{13}$ is a hydrocarbyl group of 4 to 20 carbon atoms, and in one embodiment 8 to 20 carbon atoms; each $R^{14}$ independently is hydrogen or methyl, and m is a number from 1 to 6.

In one embodiment, the ethoxylate is one where $R^{13}$ is a linear $C_{12}/C_{14}/C_{16}$ mixed alkyl group. These ethoxylates are based on $C_{12}/C_{14}/C_{16}$ mixed linear alcohols derived from coconut/palm kernel oil, and are available commercially under the name "Genapol.RTM. LA" from Clariant Corporation. The number following the "LA" (for linear), is the number of ethylene oxide (EO) repeat units in the molecule. The last digit represents the activity of the product. Thus "Genapol.RTM. 26-LA 030" indicates the hydrophoble is a $C_{12}/C_{14}/C_{16}$ mixed oleochemical alcohol with 3 moles of ethylene oxide and an activity of 100%. In an especially preferred embodiment, the alcohol ethoxylate is one where $R^{13}$ is a $C_{12}/C_{14}/C_{16}$ mixed oleochemical alcohol, $R^{14}$ is hydrogen, and m is 3.6 and is available under the name Genapol.RTM. UD 030S.

In one embodiment, the alcohol alkoxylate is one where $R^{13}$ is a $C_{11}$ alkyl group (i.e., undecyl), $R^{14}$ is hydrogen, and m is 3, 5, 7, 8, or 11. These alcohol alkoxylates which are ethoxylates (i.e., $R^{14}$ is hydrogen) are commercially available under the name "Genapol.RTM. UD" from Clariant Corporation. In this nomenclature, the first two digits of the three digit number that follow the name indicate the number of moles of ethylene oxide on the alcohol. The last digit represents the activity of the product. Thus both Genapol-.RTM. UD 070 and UD 079 contain 7 ethylene oxide repeat units, and while the former is 100% active, the latter is 90% active.

As nonionic surfactants, preference is given to fatty alcohol ethoxylates (alkyl polyethylene glycols); alkylphenol polyethylene glycols; alkyl mercaptan polyethylene glycols; fatty amine ethoxylates (alkylaminopolyethylene glycols); fatty acid ethoxylates (acyl polyethylene glycols); polypropylene glycol ethoxylates (®Pluronics); fatty acid amide polyethylene glycols; N-alkyl-, N-alkoxypolyhydroxy fatty acid amide, preferably fatty acid N-methylglucamides and sucrose esters; polyglycol ethers; alkyl polyglycosides; and/or phosphoric esters (mono-, di- and triphosphoric esters ethoxylated and nonethoxylated).

The proportion by weight of the nonionic surfactants, based on the finished compositions, is preferably 2 to 20% by weight, particularly preferably 3 to 18% by weight, especially preferably 4 to 15% by weight.

What is to be understood by the term "concentrate" and "concentrate composition" in this specification and claims is the pre-consumer dilution and composition of the cleaning composition which is the essentially the form of the product prepared for sale to the consumer or other end user. Such a consumer or other end user would then normally be expected to dilute the same with water to form a cleaning composition. It is to be understood however that nothing in this invention would bar its use as cleaning composition without any further dilution and it may be used in the concentrations in which it was prepared for sale. Similarly, what is to be understood by the term "cleaning compositions" are the water diluted compositions which are expected to be prepared by the consumer or other end user by mixing a measured amount of the "concentrate" with water in order to form an appropriately diluted cleaning composition which is suitable for use in cleaning applications, especially in the cleaning of hard surfaces.

It is also to be understood, that proportions of one or more constituents have been and generally are referred to as percent by weight or as parts by weight based on a measure of 100% by weight, unless otherwise indicated.

As generally denoted above, the formulations according to the invention include both cleaning compositions and concentrates as outlined above which differ only in the relative proportion of water to that of the other constituents forming such formulations. While the concentrated form of the cleaning compositions find use in their original form, they are more frequently used in the formation of a cleaning composition therefrom. Such may be easily prepared by diluting measured amounts of the concentrate compositions in water by the consumer or other end user in certain weight ratios of concentrate to water, and optionally, agitating the same to ensure even distribution of the concentrate in the water. As noted, the concentrate may be used without dilution, i.e., in concentrate to water concentrations of 1:0, to extremely dilute dilutions such as 1:10,000. Desirably, the concentrate is diluted in the range of 1:0.1–1:1000, preferably in the range of 1:1–1:500 but most preferably in the range of 1:10–1:100. The actual dilution selected is in part determinable by the degree and amount of dirt and grime to be removed from a surface(s), the amount of mechanical force imparted to remove the same, as well as the observed efficacy of a particular dilution. Generally better results and faster removal is to be expected at lower relative dilutions of the concentrate in water.

In accordance with preferred embodiments of the invention, when a quantity of the concentrate compositions taught herein are added to a larger volume of water, a blooming characteristic is manifested. Such "blooming" may be broadly characterized as the formation of milky, creamy or cloudy appearance which is manifested when a dilutable composition is added to a larger volume or quantity of water. The compositions of the present invention are clear and phase stable at consumer relevant temperature conditions which include a temperature of about room temperature and higher (e.g., 38° C.) for prolonged periods (e.g., after one month). The compositions exhibit exceptional blooming properties upon dilution with water. That such blooming may be attained without the use of pine oils and other bloom enhancing phenol solvents or specialty surfactants (i.e. amphoterics and amine oxides) as are commonly found in certain commercially available pine oil containing preparations is very surprising. This invention represents a huge step forward over the previous art as it reduces formulation costs, reduces volatile organic compounds (VOCs) in the system which is consistent with new regulatory initiatives to limit VOCs, and reduces undesirable solvent smells in the product.

EXAMPLES

The following examples illustrate blooming cleaning compositions of the described invention. The exemplified compositions are illustrative only and do not limit the scope of the invention. Unless otherwise specified, the proportions in the examples and elsewhere in the specification are by weight.

Example I

Table 1 presents test formulations for orange oil containing blooming cleaning compositions of the present invention which exhibited a bloom on dilution with water. All of the formulations were aqueous and included from about 4 to about 13 weight percent orange oil in combination with two anionic surfactants. The blooming effect was determined by mixing two ounces of each of the test formulations in a gallon of tap water at room temperature. The tap water was tap water available in Charlotte, N.C. All of the test formulations were initially stable, translucent microemulsions at about 70° C.

TABLE 1

BLOOMING FORMULATIONS

| Ingredient | ex. 1 | ex. 2 | ex. 3 | ex. 4 | Ex. 5 | ex. 6 | ex. 7 | ex. 8 |
|---|---|---|---|---|---|---|---|---|
| Orange Oil | 12.50 | 11.00 | 11.00 | 11.00 | 11.00 | 12.37 | 12.24 | 12.46 |
| Hostapur SAS | 3.34 | 5.50 | 4.30 | 6.00 | 6.00 | 5.53 | 5.20 | 5.85 |
| Genapol LA030S | 13.36 | 12.67 | 11.60 | 13.60 | 13.00 | 11.57 | 11.45 | 11.66 |
| Dowanol DPM | 9.00 | 8.00 | 8.00 | 8.00 | 8.00 | 7.98 | 8.89 | 7.04 |

TABLE 1-continued

BLOOMING FORMULATIONS

| | | | | | | | | |
|---|---|---|---|---|---|---|---|---|
| Sodium chloride | 0.40 | 1.00 | 1.00 | 1.00 | 1.33 | 0.98 | 1.01 | 1.21 |
| Fragrance oil | 0.00 | 0.00 | 0.07 | 0.07 | 0.07 | 0.12 | 0.12 | 0.12 |
| NaOH (1M) | 0.00 | 1.33 | 2.43 | 2.13 | 2.00 | 0.00 | 0.00 | 0.00 |
| EDTA | 0.00 | 0.00 | 0.00 | 0.00 | 0.00 | 0.00 | 0.00 | 0.00 |
| Water | 61.40 | 60.50 | 60.60 | 58.20 | 58.60 | 61.46 | 61.10 | 61.66 |

| Ingredient | ex. 9 | ex. 10 | ex. 11 | ex. 12 | ex. 13 | ex. 14 | ex. 15 |
|---|---|---|---|---|---|---|---|
| Orange Oil | 11.05 | 10.47 | 4.00 | 8.00 | 12.00 | 11.57 | 10.47 |
| Hostapur SAS | 5.46 | 5.70 | 2.18 | 4.36 | 6.55 | 6.30 | 5.70 |
| Genapol LA030S | 12.03 | 14.27 | 4.95 | 14.26 | 21.39 | 14.27 | 14.27 |
| Dowanol DPM | 8.87 | 8.00 | 25.53 | 16.67 | 8.13 | 8.00 | 8.00 |
| Sodium chloride | 1.18 | 1.00 | 1.00 | 1.00 | 1.00 | 1.00 | 1.00 |
| Fragrance oil | 0.12 | 0.07 | 0.00 | 0.00 | 0.00 | 0.07 | 0.07 |
| NaOH (1M) | 0.00 | 2.20 | 0.00 | 0.00 | 0.00 | 2.00 | 2.20 |
| EDTA | 0.00 | 0.00 | 0.00 | 0.00 | 0.00 | 0.10 | 0.10 |
| Water | 61.28 | 58.30 | 67.34 | 64.71 | 63.93 | 56.69 | 58.20 |

Example 2

Table 2 presents a comparison of the blooming effect between commercially available pine oil blooming cleaning compositions and examples of the blooming cleaning composition of the present invention. Shown by way of comparison are formulations 11, 12 and 13 which illustrate a range of orange oil composition of from about 4 to about 12 weight percent. The haze measurement describes the degree of opacity exhibited by each formulation upon dilution with water of various levels of hardness; larger haze values indicate greater opacity and therefore more noticable bloom. Water by itself is included as an experimental control and provides a haze score of zero indicative of a complete absence of bloom. Examples 11–13 exhibited exceptional bloom, particularly in water with moderate (150 ppm) to high (300 ppm) levels of dissolved inorganic salts. Thus, the natural oil cleaning oil cleaning compound of the present invention provided a more distinctive and more pronounced bloom than the commercial brands (PineSol, Pine Power).

TABLE 2

COMPARATIVE BLOOM RESULTS

| | | Haze @ 0 ppm | Haze @ 150 ppm | Haze @ 300 ppm |
|---|---|---|---|---|
| System 1 | Water | 0.00 | 0.00 | 0.00 |
| System 2 | Commercial PineSol | 11.86 | 0.03 | 0.00 |
| System 3 | Commercial Pine Power | 46.12 | 3.25 | 0.02 |
| System 4 | Example 13 | 33.46 | 86.67 | 84.20 |
| System 5 | Example 12 | 44.51 | 87.94 | 85.75 |
| System 6 | Example 11 | 30.09 | 86.74 | 86.65 |

List of Trade Names Used in Examples:

Hostapur®SAS/secondary $C_{13}$–$C_{17}$-n-alkanesulfonate, sodium salt, supplied by Clariant Corporation, Charlotte, N.C.

GENAPOL® LA030S/fatty alcohol ethoxylate with 3.6 moles of ethylene oxide supplied by Clariant Corporation, Charlotte, N.C.

Dowanol®DPM Idipropylene mono methyl ether, supplied by Dow Chemical Company, Midland, Mich.

I claim:

1. A blooming orange oil cleaning composition consisting of a) water b) about 3–20 wt-% orange oil;

c) about 2–10 wt-% of an anionic surfactant;

d) about 3–30 wt-% of a nonionic surfactant;

e) about 0–30 wt-% of dipropylene glycol monomethyl ether; and f) an additional component selected from the group consisting of inorganic salts, sequestration agents, colorants, biocidal agents, additional fragrances, viscosity modifiers, pH modifiers, degreasing agents, and mixtures thereof.

2. The blooming natural oil cleaning composition of claim 1, wherein the nonionic surfactant has an HLB below 10.

3. The blooming natural oil cleaning composition of claim 1, wherein the nonionic surfactant is selected from the group consisting of a fatty alcohol ethoxylate; an alkylphenol polyethylene glycol; an alkyl mercaptan polyethylene glycol; a fatty amine ethoxylate; a fatty acid ethoxylates; a polypropylene glycol ethoxylate; a fatty acid amide polyethylene glycol; a N-alkyl- or N-alkoxypolyhydroxy fatty acid amide, a sucrose ester; a polyglycol ether; an alkyl polyglycoside; a phosphoric ester; and mixtures thereof.

4. The blooming natural oil cleaning composition of claim 3, wherein the fatty alcohol ethoxylate is a alkyl polyethylene glycol.

5. The blooming natural oil cleaning composition of claim 3, wherein the fatty amine ethoxylate is a alkylaminopolyethylene glycol.

6. The blooming natural oil cleaning composition of claim 3, wherein the fatty acid ethoxylate is an acyl polyethylene glycol.

7. The blooming natural oil cleaning composition of claim 3, wherein the N-alkyl or N-alkoxypolyhydroxy fatty acid amide is a fatty acid N-methylglucamide.

8. The blooming natural oil cleaning composition of claim 3, wherein the phosphoric ester selected from the group consisting of mono-, di- and triphosphoric ethoxylated and nonethoxylated esters, and mixtures thereof.

9. The blooming natural oil cleaning composition of claim 1, wherein the anionic surfactant is selected from the group consisting of a $C_5$–$C_{20}$ linear alkylbenzene sulfonate, an alkyl ester sulfonate, a $C_6$–$C_{22}$ primary or secondary alkane sulfonate, a $C_6$–$C_{24}$ olefin sulfonate, a sulfonated polycarboxylic acid, an alkyl glycerol sulfonate, an fatty acyl glycerol sulfonate, a fatty oleyl glycerol sulfonate, a linear and/or branched primary alkyl sulfate, a linear and/or branched secondary alkyl sulfate, an alkyl ethoxysulfate, a fatty oleoyl glycerol sulfate, an alkyl phenol ethylene oxide ether sulfate, an alkyl ethoxy carboxylate, an alkyl polyethoxy polycarboxylate, an alkyl carboxyl soap, and mixtures thereof.

10. The blooming natural oil cleaning composition of claim 1, wherein the anionic surfactant comprises a sodium salt of secondary alkane sulfonate.

11. The blooming natural oil cleaning composition of claim 1, wherein the inorganic salts are a sodium or a potassium salt.

12. A method for cleaning a hard surface comprising adding a portion of the blooming natural oil cleaning composition of claim 1 to a greater portion of water to form a bloomed aqueous mixture and contacting the hard surface with the bloomed aqueous mixture.

13. The method of claim 12 wherein the bloomed aqueous mixture comprises a ratio range of 1:0.1 to 1:1000 of the composition to the water.

* * * * *